US009574296B2

(12) United States Patent
Kim

(10) Patent No.: US 9,574,296 B2
(45) Date of Patent: Feb. 21, 2017

(54) WASHING MACHINE

(71) Applicant: Dongbu Daewoo Electronics Corporation, Seoul (KR)

(72) Inventor: In Dong Kim, Yongin-si (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 310 days.

(21) Appl. No.: 14/187,165

(22) Filed: Feb. 21, 2014

(65) Prior Publication Data

US 2015/0176177 A1 Jun. 25, 2015

(30) Foreign Application Priority Data

Dec. 24, 2013 (KR) ..... 10-2013-0162803

(51) Int. Cl.

| | |
|---|---|
| ***D06F 35/00*** | (2006.01) |
| ***D06F 37/06*** | (2006.01) |
| ***D06F 37/26*** | (2006.01) |
| ***D06F 39/08*** | (2006.01) |

(52) U.S. Cl.

CPC ..... *D06F 37/065* (2013.01); *D06F 35/00* (2013.01); *D06F 37/261* (2013.01); *D06F 37/267* (2013.01); *D06F 39/083* (2013.01); *D06F 39/088* (2013.01)

(58) Field of Classification Search

CPC ..... D06F 35/00; D06F 37/065; D06F 37/261; D06F 37/267; D06F 39/083; D06F 39/088

USPC . 8/158, 159; 68/18 D, 23 R, 23.4, 139, 140, 68/142, 144, 208

See application file for complete search history.

(56) References Cited

U.S. PATENT DOCUMENTS 4,941,333 A 7/1990 Blessing

FOREIGN PATENT DOCUMENTS

| | | | |
|---|---|---|---|
| DE | 102 60 023 | B3 | 1/2004 |
| DE | 10 2006 031355 | A1 | 1/2008 |
| EP | 0381423 | A1 | 8/1990 |
| FR | 1 066 886 | A | 6/1954 |
| GB | 371 537 | A | 4/1932 |
| JP | 2002-282588 | A | 10/2002 |

OTHER PUBLICATIONS

European Patent Office, Extended European Search Report issued in the corresponding European Patent Application No. 14177170.9, May 7, 2015.

Korean Patent Office, Office Action issued in corresponding Korean Priority Application No. 10-2013-0162803, Feb. 25, 2015.

*Primary Examiner* — Michael Barr
*Assistant Examiner* — Levon J Shahinian

(57) ABSTRACT

The present disclosure relates to a washing machine. The washing machine may include an integrated tub/drum that includes a drum main body that has a cylindrical shape or a truncated conical shape, stores water, holds or accommodates laundry and water, and rotates, and a plurality of hollow lifters that extend or protrude outward from a circumferential surface of the drum main body, and extend or protrude inward from the circumferential surface of the drum main body; a hollow rotary shaft that is coupled to and/or that penetrates one end and/or surface of the drum main body; and a drain pipe that is in the integrated tub/drum through the hollow rotary shaft, configured to discharge water from the drum main body and that may be collected by the lifter.

6 Claims, 8 Drawing Sheets

WASHING MACHINE

CROSS-REFERENCE TO RELATED APPLICATIONS

This application is based on and claims priority from Korean Patent Application No. 10-2013-0162803, filed on Dec. 24, 2013, with the Korean Intellectual Property Office, the disclosure of which is incorporated herein in its entirety by reference.

TECHNICAL FIELD

The present disclosure relates to a washing machine, and more particularly, to a washing machine including an integral tub and drum, configured to store water and accommodate and rotate laundry.

BACKGROUND

A washing machine refers to an apparatus that eliminates foreign substances in, on or attached to laundry by agitating and rotating water, detergent and the laundry. Washing machines may be classified into pulsator type washing machines that wash the laundry using a water flow generated by operation of a pulsator in the washing tub, and drum type washing machines that wash laundry by dropping the laundry vertically, which is caused by rotation of the drum.

The drum type washing machine has a door at the front of the washing machine that allows the user to put the laundry through the door. The drum type washing machine operates in a manner that drops and washes the laundry, and uses relatively small amounts of water and detergent. Specifically, a drum type washing machine in the related art includes a cabinet that forms an external appearance of the washing machine, a tub that is installed in the cabinet and that stores water, a rotatable drum in the tub that holds or accommodates laundry, a drive motor that is installed behind and/or below the tub and that provides power to the drum, a water supply device that supplies water to the tub, and a drain device that discharges water in the tub to the outside of the cabinet after a washing operation ends.

Accordingly, in the drum type washing machine in the related art, when the laundry is washed, the laundry is put into the tub in a lateral direction by opening the door at the front of the washing machine, supplying water to the tub, and then washing the laundry while a lifter in the drum lifts up and drops the laundry by rotation of the drum, which receives rotational power from the drive motor.

As such, the drum type washing machine in the related art includes the tub in addition to a separate drum. That is, the drum type washing machine in the related art has a structure in which the tub stores water and the drum washes the laundry, wherein the drum is installed in the tub.

However, because the tub is typically made of a plastic material, the tub may be easily contaminated by mold, mildew, water scale or other foreign substances entering or generated in the tub when the tub is used over a long period of time. There is a problem in that it is difficult to clean the tub when the tub is contaminated because the drum cannot be easily removed. When the tub, which stores water, is contaminated, the tub may become corroded and then the laundry may become contaminated, which may cause a user to incur a skin irritation or disease.

This problem exists with the pulsator type washing machine as well as the drum type washing machine. The reason is that the pulsator type washing machine also includes a reservoir (tub) in a main body thereof.

According to the drum type washing machine in the related art, the drum rotates and is supported by a single shaft at a single side or end, and thus, there is also a problem in that vibration and noise may occur due to deflection(s) of the shaft.

SUMMARY

The present disclosure has been made in an effort to provide a washing machine that uses an integrated tub/drum, thereby suppressing the generation of contaminants and allowing the integrated tub/drum to be easily cleaned.

The present disclosure has been made in an effort to provide a washing machine that may effectively collect and discharge water in an integrated tub/drum.

One or more exemplary embodiments of the present disclosure provide a washing machine including: an integrated tub/drum that includes a drum main body that has a cylindrical shape or a truncated conical shape and is configured to store water, hold or accommodate laundry, and rotate; a plurality of hollow lifters that extends or protrudes outward and inward from a circumferential surface of the drum main body (e.g., that has one part that extends or protrudes outward from a circumferential surface of the drum main body, and a remaining part that extends or protrudes inward from the circumferential surface of the drum main body); a hollow rotary shaft that is coupled to and/or that penetrates one end and/or surface of the drum main body; and a drain pipe that is in the integrated tub/drum and through the hollow rotary shaft, configured to discharge water from the drum main body and/or that may be collected by the hollow lifters.

The plurality of hollow lifters may include a water collecting portion that extends or protrudes outward from the circumferential surface of the drum main body, and a lifting portion that extends or protrudes inward from the circumferential surface of the drum main body.

A plurality of holes may be in each of the lifting portions of the plurality of hollow lifters.

The water collecting portions of the plurality of hollow lifters may be longer than the lifting portions, and the water collecting portions of the plurality of hollow lifters may be closer to the drain pipe than the lifting portions.

The drum main body may have a truncated conical shape having side and/or end surfaces that intersect a rotation center axis and have different areas, and the plurality of hollow lifters may be along or aligned in a direction traversing a region between one side and/or end surface of the drum main body that has a relatively large area and another side and/or end surface of the drum main body that has a relatively small area. The hollow rotary shaft may be coupled to and/or penetrate the one surface of the integrated tub/drum that has the relatively large area.

The integrated tub/drum may further include a water collecting chamber that has a ring shape, is at an end of the drum main body toward or nearest the hollow rotary shaft, encloses a circumferential surface of the drum main body, and/or connects the water collecting portions of the plurality of hollow lifters to each other. One end of the drain pipe may extend into the water collecting chamber.

One or more other exemplary embodiments of the present disclosure provide an integrated tub/drum including: a drum main body that has a cylindrical shape or a truncated conical shape, is configured to store water, hold or accommodate laundry, and rotate; and a plurality of hollow lifters that extend or protrude outward from a circumferential surface of the drum main body, and that extend or protrude inward from the outer circumferential surface of the drum main body.

The integrated tub/drum may further include a water collecting chamber that has a ring shape, is at an end of the drum main body, encloses a circumferential surface of the drum main body, and/or connects the water collecting portions of the plurality of hollow lifters to each other.

According to exemplary embodiments of the present disclosure, the washing machine uses the integrated tub/drum, thereby suppressing the generation of contaminants and allowing the integrated tub/drum to be easily cleaned.

According to exemplary embodiments of the present disclosure, the washing machine may effectively collect and discharge water from the integrated tub/drum.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
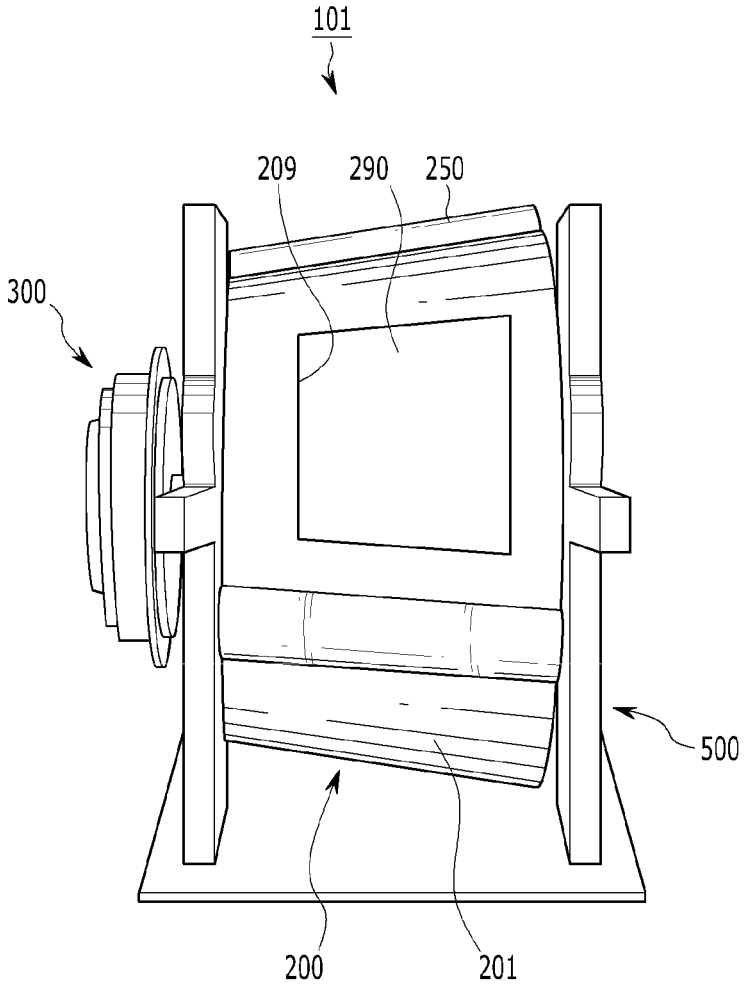
FIG. 1 is a perspective view of an exemplary washing machine according to one or more embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Hereinafter, exemplary embodiments of the present disclosure will be described in detail with reference to the accompanying drawings so that those skilled in the technical field to which the present disclosure pertains may easily carry out the exemplary embodiments. The present disclosure may be implemented in various different forms, and is not limited to the exemplary embodiments described herein.

In several exemplary embodiments, constituent elements having the same structure and/or configuration will be representatively described using the same reference numerals, and additional exemplary embodiments may be described regarding only those constituent elements that are different from the constituent elements described elsewhere.

The drawings are schematically illustrated, and the scales of the drawings are not necessarily identical to each other. Relative dimensions and ratios of the parts illustrated in the drawings may be exaggerated or reduced in terms of sizes and/or for clarification of the drawings and convenience, and any dimension is only illustrative, and is not limited thereto. The same structures, elements or components illustrated in two or more drawings are designated by the same reference numerals so as to illustrate the same or similar features.

The disclosed embodiments of the present disclosure are specifically presented as ideal exemplary embodiments of the present disclosure. As a result, various modifications of the drawings are expected. Therefore, the exemplary embodiments are not limited to specific forms or regions illustrated in the drawings, and for example, include modifications of form by manufacturing.

Hereinafter, a washing machine 101 according to one or more exemplary embodiments of the present disclosure will be described with reference to FIGS. 1 to 5.

Figure 2:
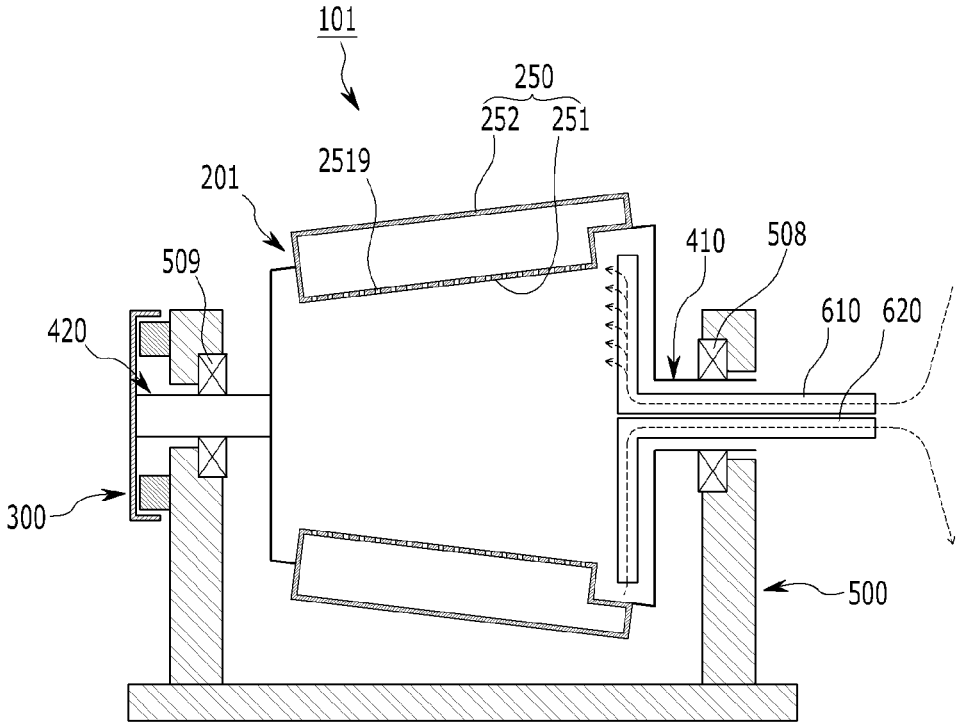
FIG. 2 is a cross-sectional view of an exemplary washing machine according to one or more further embodiments of the present disclosure.

As illustrated in FIGS. 1 and 2, the washing machine 101 according to exemplary embodiments of the present disclosure includes an integrated tub/drum 201, a hollow rotary shaft 410, and a drain pipe 620.

The washing machine 101 according to exemplary embodiments of the present disclosure may further include a water supply pipe 610, a supporting frame 500, a supporting bearing 508, a drive bearing 509, a drive shaft 420, and a motor 300.

Figure 5:
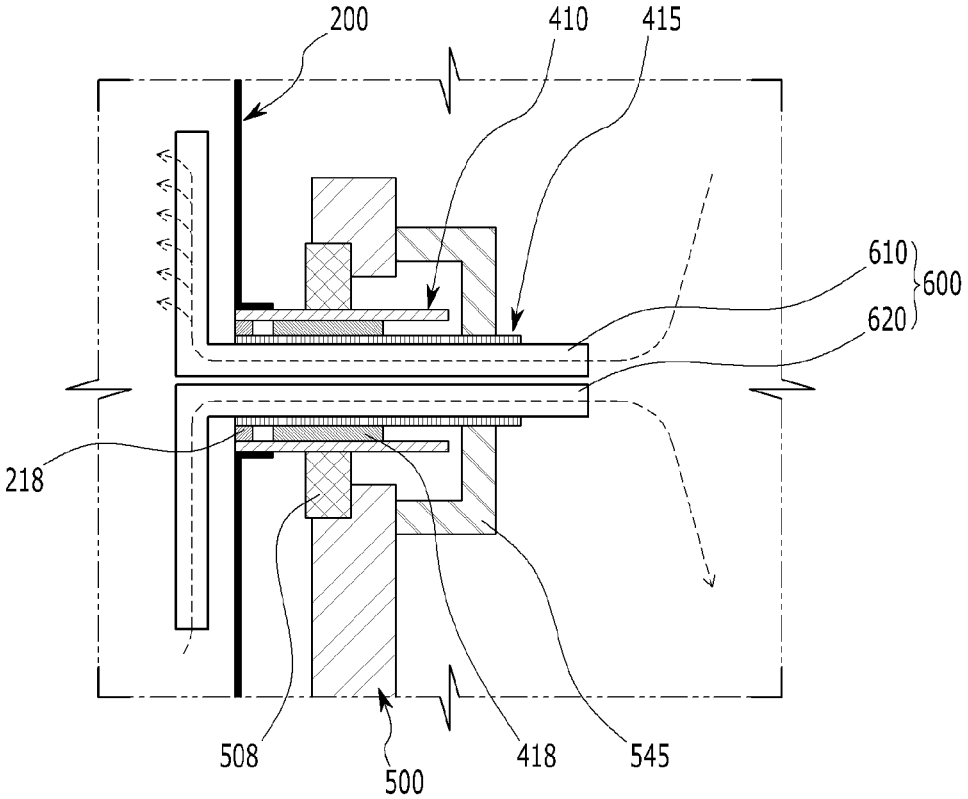
FIG. 5 is an enlarged cross-sectional view of an exemplary hollow rotary shaft according to one or more embodiments of the present disclosure.

As illustrated in FIG. 5, the washing machine 101 according to exemplary embodiments of the present disclosure may further include a fixed shaft 415, a rotary bearing 418, a water seal 218, and a shaft fixing frame 545.

Although not illustrated, the washing machine 101 may further include a cabinet, and a water supply valve and/or pump, and a drain pump.

The cabinet forms an external shape and/or appearance of the washing machine 101, and a control panel for controlling the washing machine 101 may be on the cabinet. Because the cabinet may have one or more various shapes that are known to those skilled in the art, a detailed description thereof will be omitted.

The water supply valve and/or pump supplies water through the water supply pipe 610, and the drain pump drains or removes water from the integrated tub/drum 201 through the drain pipe 620. Because the water supply valve and/or pump and the drain pump in the washing machine 101 are also known to those skilled in the art, a detailed description thereof will be omitted.

The integrated tub/drum 201 stores water, holds or accommodates laundry together with the water and detergent, and rotates. The integrated tub/drum 201 may comprise or be made of stainless steel. Alternatively, the integrated tub/drum 201 may comprise or be made of another metal and/or plastic, and have a ceramic and/or stain-resistant coating on the inner surface thereof. Thus, the integrated tub/drum 201, which stores the water, is not easily contaminated by water scale, mold, mildew, or other foreign substances, and may be easily cleaned even if the integrated tub/drum 201 is contaminated. In the case of a washing machine in which the tub and the drum are separate, there is a problem in that the drum needs to be removed or separated from the tub in order to clean the tub, but embodiments of the present disclosure include the integrated tub/drum 201, which may be easily cleaned.

In exemplary embodiments of the present disclosure, the integrated tub/drum 201 may include a drum main body 210, and a plurality of hollow lifters 250.

The drum main body 210 may have a cylindrical shape or a truncated conical shape, store water, hold or accommodate the laundry, and rotate.

Figure 3:
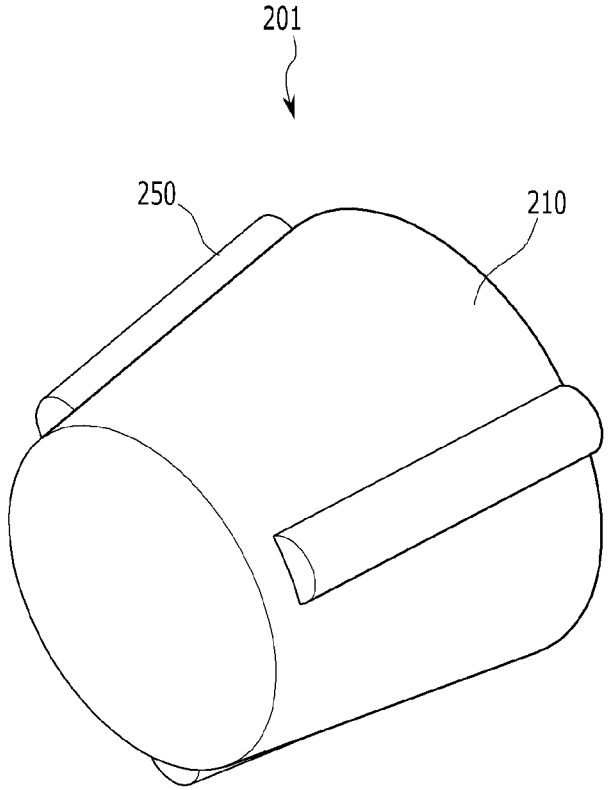
FIG. 3 is a perspective view of an exemplary integrated tub/drum according to one or more embodiments of the present disclosure.

Referring to FIGS. 1 to 3, the drum main body 210 may have a truncated conical shape in which areas of the vertical ends or sides, which intersect a central rotation axis of the integrated tub/drum 201, have different areas, but exemplary embodiments of the present disclosure are not particularly limited thereto, and the drum main body 210 may also have a cylindrical shape.

As illustrated in FIGS. 2 and 3, the plurality of hollow lifters 250 may have one part that extends or protrudes outward from a circumferential surface of the drum main body 210, and a remaining part that extends or protrudes inward from the circumferential surface of the drum main body 210.

Figure 4:
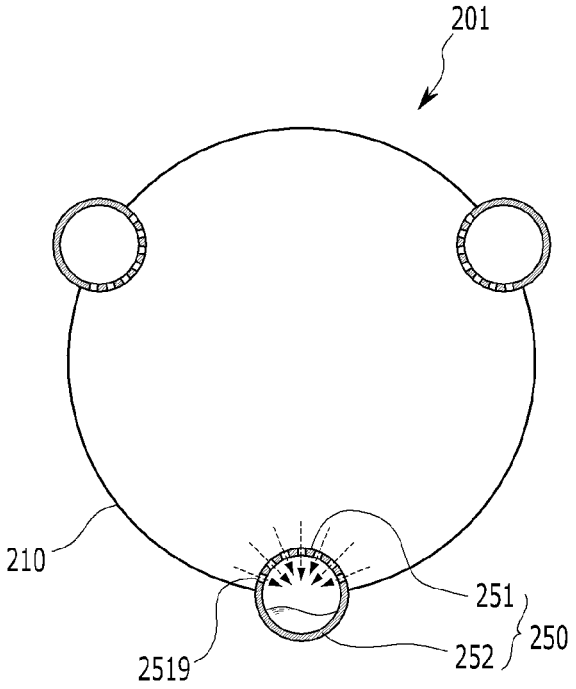
FIG. 4 is a cross-sectional view of the exemplary integrated tub/drum according to embodiments of the present disclosure.

Specifically, as illustrated in FIG. 4, the plurality of hollow lifters 250 includes a water collecting portion 252 that extends or protrudes outward from the circumferential surface of the drum main body 210, and a lifting portion 251 that extends or protrudes inward from the circumferential surface of the drum main body.

Accordingly, when the integrated tub/drum 201 rotates, the laundry in the integrated tub/drum 201 is washed while being caught and lifted up by the lifting portion 251 of the hollow lifter 250 due to rotational force of the integrated tub/drum 201, and then dropped back into the water as the integrated tub/drum 201 rotates. The lifters 250 generally comprise a plastic cylinder having a predetermined minimum hardness (e.g., polyvinyl chloride, polycarbonate, etc.) and/or a predetermined thickness. The lifters 250 can be secured in place in openings in the drum main body 210 (e.g., FIGS. 2 and 3), or sections of the drum main body 210 can be glued or adhered (e.g., using a silicone sealant) to opposite sides of the lifters 250. The lifters 250 may also have slots or grooves along the sides thereof configured to receive edges of the drum main body 210. A silicone caulk or sealant can be applied along the interfaces between the lifters 250 and the drum main body 210.

The lifting portion 251 and the water collecting portion 252 each may have a cross section having a semi-circular shape. However, exemplary embodiments of the present disclosure is not limited thereto. For example, the lifters can also have any of a variety of cross-sectional shapes (e.g., square, rectangular, oval, egg-shaped, hexagonal, a combination thereof, etc.).

A plurality of holes 2519 are in each of the lifting portions 251 of the plurality of hollow lifters 250. Therefore, the water that flows into the hollow lifter 250 through the holes 2519 of the lifting portion 251 collects in the water collecting portion 252.

In exemplary embodiments of the present disclosure, as illustrated in FIG. 2, the water collecting portions 252 of the plurality of hollow lifters 250 may be longer than the lifting portions 251, and the water collecting portions 252 of the plurality of hollow lifters 250 may be closer to the drain pipe 620, which will be described below, than the lifting portions 251.

Therefore, the water collected in the water collecting portion 252 may be easily discharged through the drain pipe 620. For clarity purposes, the drain pipe 620 in FIG. 2 does not extend into the water collecting portions 252, but typically will do so to maximize the capability of the washing machine to remove or drain water from the integrated tub/drum 201 (see, e.g., FIG. 8). Alternatively, the slope of the end of the water collecting portions 252 nearest to the drain pipe 620 may decrease to facilitate removing or draining the water from the integrated tub/drum 201.

As described above, the plurality of hollow lifters 250 may lift up the laundry, and may also effectively discharge residual water contained in the laundry when the laundry is spin-dried.

When the drum main body 210 has a truncated conical shape, the plurality of hollow lifters 250 is along or aligned in a direction traversing a region between the vertical sides, ends and/or surfaces of the drum main body 210, one of which has a relatively large area and the other which has a relatively small area.

The integrated tub/drum 201 may include an opening 209 in one region of the circumferential surface of the integrated tub/drum 201. The laundry may be put into the integrated tub/drum 201, or the laundry in the integrated tub/drum 201 may be taken out of the integrated tub/drum 201, through the opening 209.

The washing machine 101 according to exemplary embodiments of the present disclosure may further include a drum cover 290 that is separably or removably coupled to the opening 209 of the integrated tub/drum 201. The drum cover 290 is separated or removed from the integrated tub/drum 201 when the laundry is put into or taken out of the integrated tub/drum 201, and coupled to the opening 209 of the integrated tub/drum 201 to seal the internal space of the integrated tub/drum 201 when the laundry is washed.

The supporting frame 500 supports the hollow rotary shaft 410 so that the hollow rotary shaft 410 can rotate. The supporting frame 500 may be accommodated in or coupled to the cabinet (not illustrated). The supporting frame 500 may have one or more shapes that intersect in an 'X' shape or 'V' shape, and the hollow rotary shaft 410 may be supported at the intersection or vertex thereof.

However, exemplary embodiments of the present disclosure are not limited thereto, and the supporting frame 500 may have various structures that may be modified and carried out by those skilled in the art based on known technology.

The water supply pipe 610 and the drain pipe 620 are in the integrated tub/drum 201 and through the hollow rotary shaft 410. The water supply pipe 610 supplies water to the interior of the integrated tub/drum 201, and the drain pipe 620 discharges water from the interior of the integrated tub/drum 201.

In exemplary embodiments of the present disclosure, the drain pipe 620 may be pass through the hollow rotary shaft 410, and bend downward in the integrated tub/drum 201.

The hollow rotary shaft 410 is coupled to and/or penetrates through the end and/or surface of the integrated tub/drum 201 that has a relatively large area, and thus the drain pipe 620, that bends downward, is also adjacent to the vertical end and/or surface of the integrated tub/drum 201 that has a relatively large area.

Depending on a gradient of the integrated tub/drum 201 having a truncated conical shape, the water collects along the hollow lifters 250 in a direction toward the end and/or surface of the integrated tub/drum 201 that has a relatively large area. In this case, the drain pipe 620 is adjacent to and/or in the water collecting portion 252 of the hollow lifter 250, and thus the water collected in the water collecting portion 252 may be easily discharged. That is, the drain pipe 620 may effectively discharge the water that collects in the water collecting portion 252 of the hollow lifter 250, in the direction toward the vertical end and/or surface of the integrated tub/drum 201 that has a relatively large area.

In exemplary embodiments of the present disclosure, the water supply pipe 610 may pass through the hollow rotary shaft 410, and then bend upward, and/or leftward or rightward, in the integrated tub/drum 201. FIG. 2 illustrates the water supply pipe 610 bent upward, but exemplary embodiments of the present disclosure are not limited thereto, and the water supply pipe 610 may bend leftward or rightward, or may not be bent.

As illustrated in FIG. 5, the hollow rotary shaft 410 is coupled to and/or penetrates an end panel or surface of the integrated tub/drum 201 such that a hollow space of the hollow rotary shaft 410 communicates with the interior of the integrated tub/drum 201. Particularly, in exemplary embodiments of the present disclosure, the hollow rotary shaft 410 is coupled to and/or penetrates the end and/or surface of the integrated tub/drum 201 that has a relatively large area.

The fixed shaft 415 is in the hollow space of the hollow rotary shaft 410 and does not rotate. The fixed shaft 415 supports the water supply pipe 610 and the drain pipe 620 in the fixed shaft 415. That is, when the hollow rotary shaft 410 rotates, the water supply pipe 610 and the drain pipe 620, which are in the fixed shaft 415, do not rotate.

One end of the fixed shaft 415 extends or protrudes to the outside of the hollow rotary shaft 410, and the shaft fixing brace or bracket 545 connects the one (extended) end of the fixed shaft 415 to the supporting frame 500. That is, the shaft fixing brace or bracket 545 is coupled to the supporting frame 500 to support the fixed shaft 415, so that the fixed shaft 415 does not rotate in the hollow rotary shaft 410.

The rotary bearing 418 is between the hollow rotary shaft 410 and the fixed shaft 415 so that the hollow rotary shaft 410 and the fixed shaft 415 are rotatable and/or slidable relative to each other. That is, the rotary bearing 418 enables the hollow rotary shaft 410 to rotate while the fixed shaft 415 is fixed. For example, the rotary bearing 418 may be or comprise a needle roller bearing.

The water seal 218 is between the hollow rotary shaft 410 and the fixed shaft 415, and is configured to block the water in the integrated tub/drum 201 from flowing into the rotary bearing 418 through the hollow rotary shaft 410.

The supporting bearing 508 is between the hollow rotary shaft 410 and the supporting frame 500. The supporting bearing 508 helps the supporting frame 500 to support the hollow rotary shaft 410 so that the hollow rotary shaft 410 is rotatable.

As illustrated previously in FIG. 2, the drive shaft 420 is coupled to another vertical end and/or surface of the integrated tub/drum 201 (that is, the surface that is opposite to the end and/or surface to which the hollow rotary shaft 410 is coupled). The integrated tub/drum 201 rotates while being supported by the drive shaft 420 and the hollow rotary shaft 410.

Like the hollow rotary shaft 410, the drive shaft 420 is also supported by the supporting frame 500. The drive shaft 420 may also be supported at the intersection or vertex of the supporting frame 500.

The drive bearing 509 is between the drive shaft 420 and the supporting frame 500. That is, the drive bearing 509 helps the supporting frame 500 to support the drive shaft 420 so that the drive shaft 420 is rotatable.

The drive motor 300 rotates the drive shaft 420, and provides rotational power to the integrated tub/drum 201.

In exemplary embodiments of the present disclosure, the drive motor 300 may rotate the integrated tub/drum 201 so that the opening 209 of the integrated tub/drum 201 is positioned at a relatively upper location (e.g., the top or near the top of the integrated tub/drum 201; for example, between 10 o'clock and 2 o'clock when viewing the end of the integrated tub/drum 201 as a clock face) when the laundry is put into or taken out of the integrated tub/drum 201. That is, the drive motor 300 may move the opening 209 of the integrated tub/drum 201 to a position where the user can conveniently put the laundry into the integrated tub/drum 201 or take the laundry out of the integrated tub/drum 201.

According to the aforementioned configuration, the washing machine 101 may uses the integrated tub/drum 201 to suppress the formation and/or generation of contaminants, and allow the integrated tub/drum 201 to be easily cleaned.

According to exemplary embodiments of the present disclosure, the washing machine 101 may lift up the laundry in the integrated tub/drum 201, and simultaneously effectively collect and discharge the water.

According to exemplary embodiments of the present disclosure, the drive shaft 420 and the hollow rotary shaft 410 rotate while supporting both ends and/or surfaces of the integrated tub/drum 201 that are opposite to each other, and any cantilevered beam deflection of the shaft may be prevented, as compared to the case in which the drum rotates on a single shaft connected to one surface of the drum, thereby remarkably reducing vibration and noise.

Hereinafter, a washing machine 102 according to one or more further exemplary embodiments of the present disclosure will be described with reference to FIGS. 6 to 8.

Figure 6:
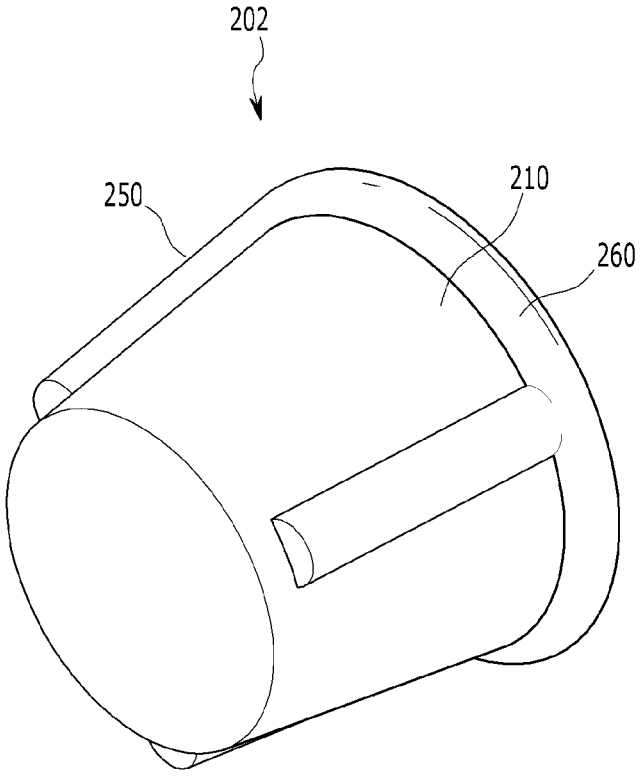
FIG. 6 is a perspective view of an exemplary integrated tub/drum according to one or more further embodiments of the present disclosure.
Figure 7:
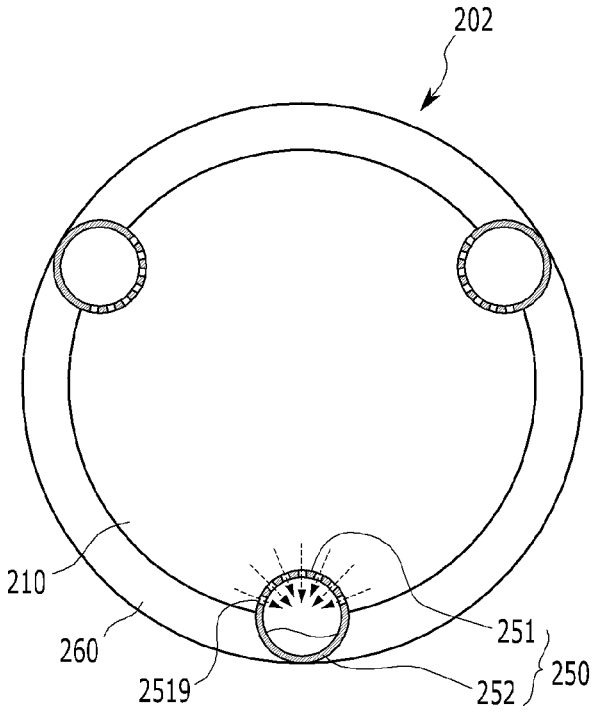
FIG. 7 is a cross-sectional view of the integrated tub/drum of FIG. 6.

As illustrated in FIGS. 6 and 7, in the washing machine 102 according to further exemplary embodiments of the present disclosure, an integrated tub/drum 202 may further include a water collecting chamber 260 that has a ring shape, is at an end of the drum main body 210 (e.g., in a direction toward the end and/or surface of the drum main body 210 that is coupled to the hollow rotary shaft 410), encloses a circumferential surface of the drum main body 210, and/or connects the water collecting portions 252 of a plurality of hollow lifters 250 to each other.

According to further exemplary embodiments of the present disclosure, water that collects in the water collecting portions 252 of the plurality of hollow lifters 250, is collected in and/or transferred to the water collecting chamber 260.

Figure 8:
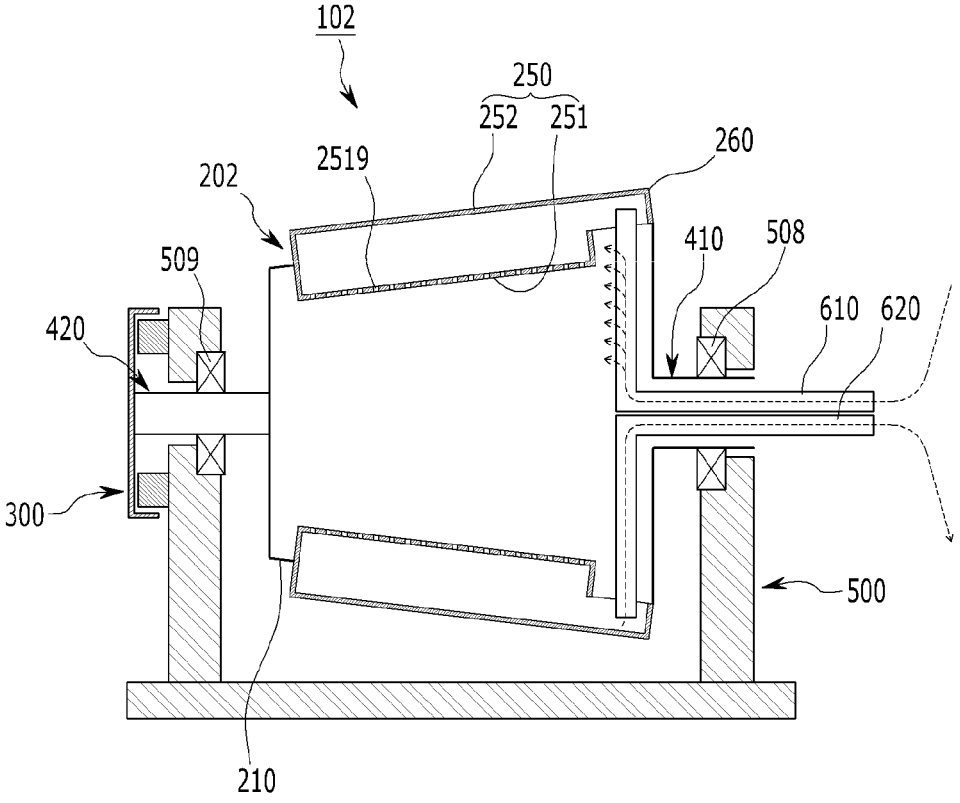
FIG. 8 is a cross-sectional view of an exemplary washing machine according to one or more further embodiments of the present disclosure.

As illustrated in FIG. 8, one end of the drain pipe 620 may extend into the water collecting chamber 260.

Since the water collecting chamber 260 has a circular, toroidal, or ring shape, even though the one end of the drain pipe 620 extends into the water collecting chamber 260, the drain pipe 620, which is fixed, and the integrated tub/drum 202, which rotates, do not interfere with each other when the integrated tub/drum 202 rotates.

The drain pipe 620 may approach more closely to the water in the water collecting chamber 260, thereby more effectively discharging the water.

According to the aforementioned configuration, the washing machine 102 according to further exemplary embodiments of the present disclosure may more effectively collect the water and effectively discharge the water.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A washing machine comprising:

an integrated tub/drum that includes a drum main body that has a cylindrical or truncated conical shape, is configured to store water, hold or accommodate laundry, and rotate, and a plurality of hollow lifters that protrude or extend outward from a circumferential surface of the drum main body and inward from the circumferential surface of the drum main body;

a hollow rotary shaft coupled to and/or penetrating one surface of the drum main body; and a drain pipe in the integrated tub/drum through the hollow rotary shaft, configured to discharge water in the drum main body or the hollow lifters, wherein the plurality of hollow lifters includes a water collecting portion that extends or protrudes outward from the circumferential surface of the drum main body, and a lifting portion that extends or protrudes inward from the circumferential surface of the drum main body, wherein the water collecting portions are longer than the lifting portions, and the water collecting portions are closer to the drain pipe than the lifting portions, wherein the integrated tub/drum further includes a water collecting chamber that protrude or extend outward from a circumferential surface of the drum main body at an end of the drum main body nearest to the hollow rotary shaft, enclosing a circumferential surface of the drum main body and connecting the water collecting portions of the plurality of hollow lifters to each other, and wherein one end of the drain pipe extends into the water collecting chamber.

2. The washing machine of claim 1, wherein each of the lifting portions includes a plurality of holes therein.

3. The washing machine of claim 1, wherein the drum main body has a truncated conical shape having side and/or end surfaces that intersect a rotation center axis and have different areas, and the plurality of hollow lifters are in a direction traversing a region between the side and/or end surfaces of the drum main body.

4. The washing machine of claim 3, wherein one side and/or end surface of the drum main body has a relatively large area and another side and/or end surface of the drum main body has a relatively small area.

5. The washing machine of claim 4, wherein the hollow rotary shaft is coupled to and/or penetrates the one surface of the integrated tub/drum that has a relatively large area.

6. The washing machine of claim 1, wherein the water collecting chamber has a ring shape.

* * * * *